US007338739B2

(12) United States Patent
Qi et al.

(10) Patent No.: US 7,338,739 B2
(45) Date of Patent: Mar. 4, 2008

(54) CROSSLINKED SILOXANE COMPOSITE OVERCOAT FOR PHOTORECEPTORS

(75) Inventors: Yu Qi, Oakville (CA); Nan-Xing Hu, Oakville (CA); Timothy P. Bender, Mississauga (CA); Yvan Gagnon, Mississauga (CA); John Graham, Oakville (CA); Cheng-Kuo Hsiao, Mississauga (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 314 days.

(21) Appl. No.: 11/034,713

(22) Filed: Jan. 14, 2005

(65) Prior Publication Data

US 2006/0160002 A1 Jul. 20, 2006

(51) Int. Cl.
*G03G 15/04* (2006.01)
*G03G 15/00* (2006.01)

(52) U.S. Cl. ..... 430/66; 399/159

(58) Field of Classification Search ..... 430/66, 430/58.2; 399/159
See application file for complete search history.

(56) References Cited

U.S. PATENT DOCUMENTS

| | | | | |
|---|---|---|---|---|
| 6,300,027 | B1 * | 10/2001 | Chambers et al. | 430/58.2 |
| 6,730,448 | B2 | 5/2004 | Yoshino et al. | |
| 2003/0054271 | A1 * | 3/2003 | Yao et al. | 430/66 |
| 2003/0118366 | A1 * | 6/2003 | Nukada et al. | 399/109 |
| 2003/0190545 | A1 * | 10/2003 | Daimon et al. | 430/124 |
| 2003/0232262 | A1 * | 12/2003 | Yamada et al. | 430/58.2 |
| 2004/0086794 | A1 * | 5/2004 | Yamada et al. | 430/56 |
| 2004/0229141 | A1 * | 11/2004 | Goodbrand et al. | 430/58.05 |
| 2005/0233231 | A1 * | 10/2005 | Qi et al. | 430/58.65 |

* cited by examiner

*Primary Examiner*—Mark F. Huff
*Assistant Examiner*—Peter Vajda
(74) *Attorney, Agent, or Firm*—Oliff & Berridge, PLC

(57) ABSTRACT

A crosslinked siloxane composite overcoat for electrophotographic photoreceptors, containing at least one siloxane-containing compound, a resin and metal oxide particles; photoreceptors containing the crosslinked siloxane composite overcoat; and image process cartridge and image forming apparatuses containing photoreceptors containing the crosslinked siloxane composite overcoat.

22 Claims, 3 Drawing Sheets

CROSSLINKED SILOXANE COMPOSITE OVERCOAT FOR PHOTORECEPTORS

BACKGROUND OF THE INVENTION

1. Field of Invention

The present invention relates to a protective layer for electrophotographic photoreceptors, and process cartridges and image forming apparatuses containing photoreceptors having protective layers.

2. Description of Related Art

In xerography, or electrophotographic printing/copying, a charge-retentive device called a photoreceptor is electrostatically charged. For optimal image production, the photoreceptor should be uniformly charged across its entire surface. The photoreceptor is then exposed to a light pattern of an input image to selectively discharge the surface of the photoreceptor in accordance with the image. The resulting pattern of charged and discharged areas on the photoreceptor forms an electrostatic charge pattern (i.e., a latent image) conforming to the input image. The latent image is developed by contacting it with finely divided electrostatically attractable powder called toner. Toner is held on the image areas by electrostatic force. The toner image may then be transferred to a substrate or support member, and the image is then affixed to the substrate or support member by a fusing process to form a permanent image thereon. After transfer, excess toner left on the photoreceptor is cleaned from its surface, and residual charge is erased from the photoreceptor.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Current layered photoreceptors generally have at least a flexible substrate support layer and two active layers. These active layers generally include a charge generating layer containing a light absorbing material, and a charge transport layer containing electron donor molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

An electrostatographic photoreceptor can be in a rigid drum configuration or in a flexible belt configuration that can be either a seamless or a seamed belt. Typical electrophotographic photoreceptor drums comprise a charge transport layer and a charge generating layer coated over a rigid conducting substrate support drum. However, for flexible electrophotographic photoreceptor belts, the charge transport layer and charge generating layer are coated on top of a flexible substrate support layer. To ensure that the photoreceptor belts exhibit sufficient flatness, an anticurl backing layer can be coated onto the back side of the flexible substrate support layer to counteract upward curling and ensure photoreceptor flatness.

In many modern electrophotographic imaging systems the flexible photoreceptor belts are repeatedly cycled to achieve high speed imaging. As a result of this repetitive cycling, the outermost layer of the photoreceptor experiences a high degree of frictional contact with other machine subsystem components used to clean and/or prepare the photoreceptor for imaging during each cycle. When repeatedly subjected to cyclic mechanical interactions against the machine subsystem components, photoreceptor belts can experience severe frictional wear at the outermost organic photoreceptor layer surface that can greatly reduce the useful life of the photoreceptor. Ultimately, the resulting wear impairs photoreceptor performance and thus image quality.

In order to mitigate erosion of the top outermost layer during these processes, the outermost layer can be coated with a thin protective layer, such as the overcoat disclosed in U.S. Patent Application Publication No. US 2004/0086794 A1, incorporated herein by reference in its entirety.

SUMMARY OF THE INVENTION

Applicants have discovered several shortcomings associated with overcoat layers. In particular, Applicants have discovered that electrical charges can migrate from the photoreceptor surface into the porous overcoat, and cause image problems. Furthermore, another shortcoming is the high torque required to rotate the coated photoreceptor against a cleaning blade.

Accordingly, it is an object of the invention to provide an improved overcoat that improves the wear rate of the photoreceptor without sacrificing electrographic performance.

Applicants have discovered that an overcoat containing a crosslinked siloxane composite composition containing at least one siloxane-containing compound and metal oxide particles overcomes the above-described shortcomings associated with overcoat layers. Specifically, Applicants have discovered that such a crosslinked siloxane composite overcoat reduces the torque requirement of a coated photoreceptor, improves the wear resistance, and has no adverse effect on electrical properties.

In embodiments, the crosslinked siloxane composite overcoat comprises at least one siloxane-containing compound, a resin and metal oxide particles. In various embodiments, the crosslinked siloxane composite overcoat comprises a hole transport molecule containing at least one active silicone group, a binder containing at least one silicone functional group, a resin, optionally a siloxane, and metal oxide particles. In various embodiments, the crosslinked siloxane composite overcoat comprises metal oxide particles and the overcoat disclosed in U.S. Patent Application Publication No. US 2004/0086794 A1, incorporated herein by reference in its entirety.

In embodiments, the photoreceptor of the invention comprises a charge generating layer, a charge transport layer, and a protective layer. The protective layers comprises an overcoat containing a crosslinked siloxane composite composition containing at least one siloxane-containing compound and metal oxide particles. In embodiments, the photoreceptor of the invention is coated from sol gel solutions.

In embodiments, the process cartridge of the invention comprises an electrophotographic photoreceptor comprising at least one siloxane-containing compound, a resin and metal oxide particles, and at least one of a developing unit and a cleaning unit. In various embodiments, the image forming apparatus comprises an electrophotographic photoreceptor comprising a silicon compound, a resin and metal oxide particles, at least one charging unit, at least one exposing unit, at least one developing unit, a transfer unit, and a cleaning unit.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
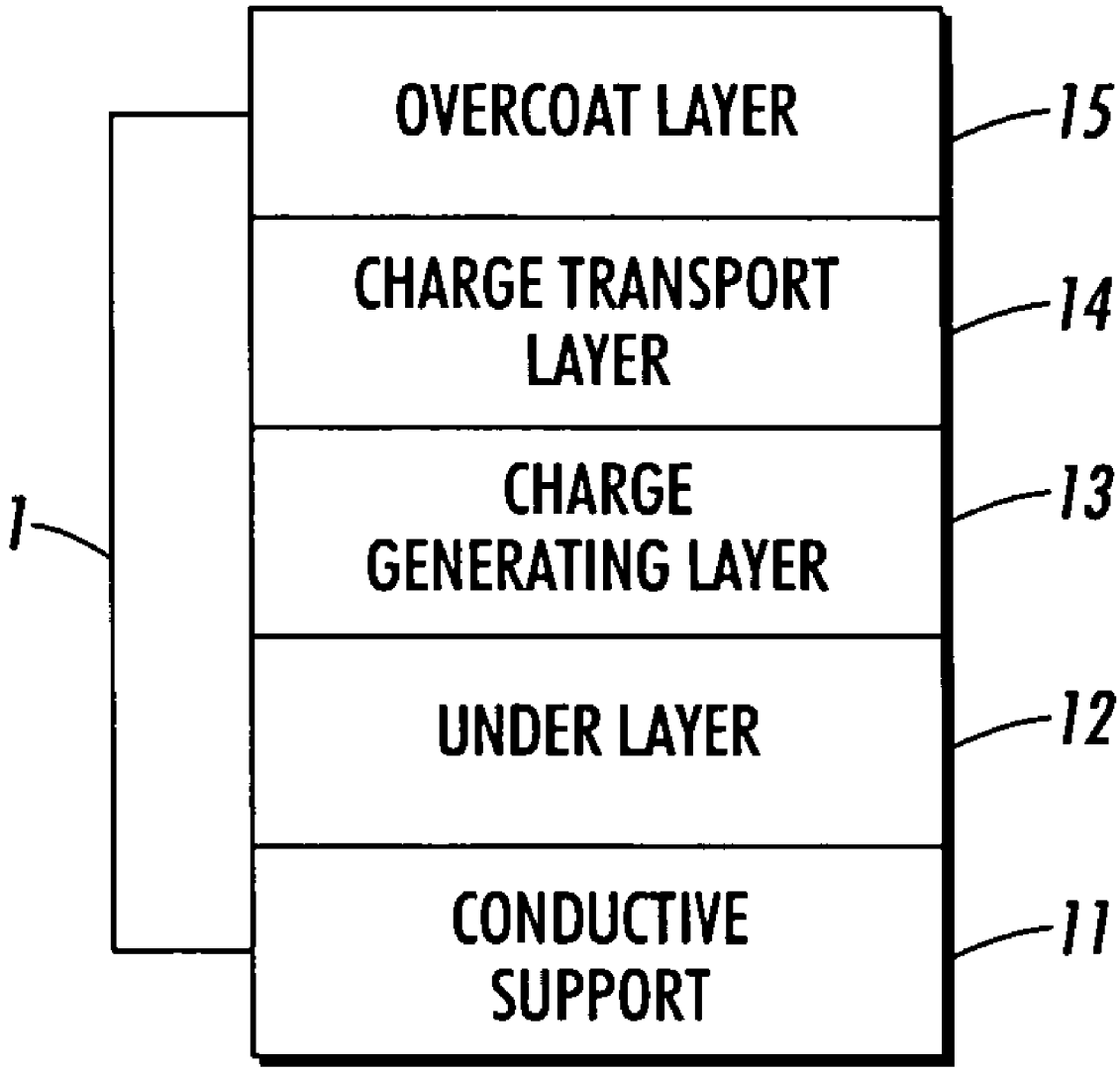
FIG. 1 is a block diagram outlining the elements of an electrophotographic photoreceptor.

In electrophotographic photoreceptors of embodiments, the electrophotographic photoreceptor comprising one or more siloxane-containing compound, a resin and metal oxide particles.

In embodiments, the crosslinked siloxane composite overcoat contains at least one member selected from silicon-containing compounds represented by the following general formulas (1) to (3) and hydrolysates or hydrolytic condensates thereof may be used.

$$W^1(\text{—}SiR_{3-a}Q_a)_2 \quad (1)$$

$$W^2(\text{-}D\text{-}SiR_{3-a}Q_a)_b \quad (2)$$

$$SiR_{4-c}Q_c \quad (3)$$

In general formulas (1) to (3), $W^1$ represents a divalent organic group, $W^2$ represents an organic group derived from a compound having hole transport capability, Q represents a hydrolytic group, D represents a divalent group, a represents an integer of 1 to 3, b represents an integer of 2 to 4, and c represents an integer of 1 to 4.

R in general formulas (1) to (3) represents a hydrogen atom, an alkyl group such as an alkyl group having 1 to 5 carbon atoms or a substituted or unsubstituted aryl group, such as a substituted or unsubstituted aryl group having 6 to 15 carbon atoms, as described above.

Further, the hydrolytic group represented by Q in general formulas (1) to (3) means a functional group that can form a siloxane bond (O—Si—O) by hydrolysis in the curing reaction of the compound represented by any one of general formulas (1) to (3). Non-limiting examples of hydrolytic groups that may be used in embodiments include a hydroxyl group, an alkoxyl group, a methyl ethyl ketoxime group, a diethylamino group, an acetoxy group, a propenoxy group and a chloro group. In particular embodiments, a group represented by —OR" (R" represents an alkyl group having 1 to 15 carbon atoms or a trimethylsilyl group) may be used.

In general formula (2), the divalent group represented by D may be, in embodiments, a divalent hydrocarbon group represented by $\text{—}C_nH_{2n}\text{—}$, $\text{—}C_nH_{2n-2}\text{—}$, $\text{—}C_nH_{2n-4}\text{—}$ (n is an integer of 1 to 15, and preferably an integer of 2 to 10), $\text{—}CH_2\text{—}C_6H_4\text{—}$ or $\text{—}C_6H_4\text{—}C_6H_4\text{—}$, an oxycarbonyl group (—COO—), a thio group (—S—), an oxy group (—O—), an isocyano group (—N═CH—) or a divalent group in which two or more such groups are combined. The divalent group D may have a substituent group such as an alkyl group, a phenyl group, an alkoxyl group or an amino group on its side chain. When D is one of the above-mentioned divalent groups, proper flexibility may be imparted to an organic silicate skeleton, which improves the strength of the layer.

Non-limiting examples of the compounds represented by the above-mentioned general formula (1) are shown in Table 1.

TABLE 1

| No. | Structural Formula |
|---|---|
| I-1 | $(MeO)_3Si\text{—}(CH_2)_2\text{—}Si(OMe)_3$ |
| I-2 | $(MeO)_2Me\text{—}(CH2)_2\text{—}SiMe(OMe)_2$ |
| I-3 | $(MeO)_2MeSi\text{—}(CH_2)_6\text{—}SiMe(OMe)_2$ |
| I-4 | $MeO)_3Si\text{—}(CH_2)_6\text{—}Si(OMe)_3$ |
| I-5 | $(EtO)_3Si\text{—}(CH_2)_6\text{—}Si(OEt)_3$ |
| I-6 | $(MeO)_2MeSi\text{—}(CH_2)_{10}\text{—}SiMe(OMe)_2$ |
| I-7 | $(MeO)_3Si\text{—}(CH_2)_3\text{—}NH\text{—}(CH_2)_3\text{—}Si(OMe)_3$ |
| I-8 | $(MeO)_3Si\text{—}(CH_2)_3\text{—}NH\text{—}(CH_2)_2\text{—}NH\text{—}(CH_2)_3\text{—}Si(OMe)_3$ |
| I-9 | 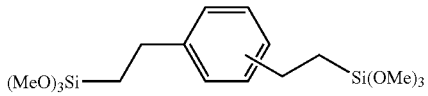 |

TABLE 1-continued

| No. | Structural Formula |
|---|---|
| I-10 | 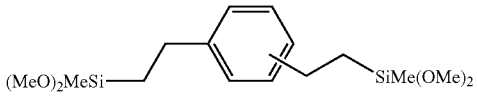 |
| I-11 | 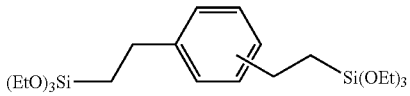 |
| I-12 | 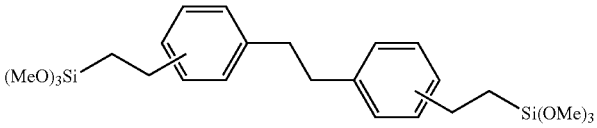 |
| I-13 | 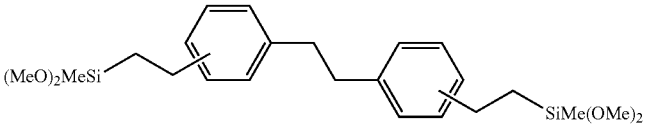 |
| I-14 | 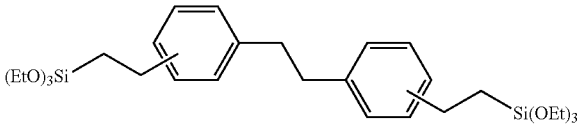 |
| I-15 | $(MeO)_3SiC_3H_6$—O—$CH_2CH\{$—O—$C_3H_6Si(OMe)_3\}$—$CH_2\{$—O—$C_3H_6Si(OMe)_3\}$ |
| I-16 | $(MeO)_3SiC_2H_4$—$SiMe_2$—O—$SiMe_2$—O—$SiMe_2$—$C_2H_4Si(OMe)_3$ |

Further, in the above-mentioned general formula (2), there is no particular limitation on the organic group represented by $W^2$, as long as it is a group having hole transport capability. However, in particular embodiments, $W^2$ may be an organic group represented by the following general formula (4):

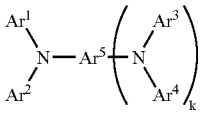

(4)

wherein $Ar^1$, $Ar^2$, $Ar^3$ and $Ar^4$, which may be the same or different, each represents a substituted or unsubstituted aryl group, $Ar^5$ represents a substituted or unsubstituted aryl or arylene group, k represents 0 or 1, and at least one of $Ar^1$ to $Ar^5$ may be connected with -D-$SiR_{3-a}Q_a$ in general formula (2).

$Ar^1$ to $Ar^4$ in the above-mentioned general formula (4) are each preferably any one of the following formulas (5) and (6):

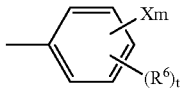

(5)

—Ar-$Z'_5$-Ar-Xm (6)

In formulas (5) and (6), $R^6$ represents a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; Ar represents a substituted or unsubstituted arylene group; X represents -D-$SiR_{3-a}Q_a$ in general formula (2); m represents 0 or 1; and t represents an integer of 1 to 3.

Here, Ar in formula (6) may be one represented by the following formula (7) or (8):

(7)

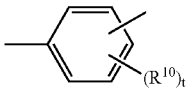

(8)

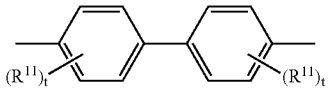

In formulas (7) and (8), $R^{10}$ and $R^{11}$ each represent a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; and t represents an integer of 1 to 3.

Further, Z' in formula (6) is preferably one represented by any one of the following formulas (9) to (16):

$$—(CH_2)_q— \quad (9)$$

$$—(CH_2CH_2O)_r— \quad (10)$$

(11)

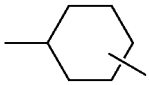

(12)

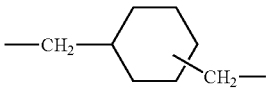

(13)

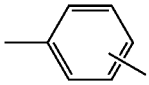

(14)

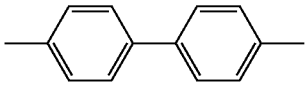

(15)

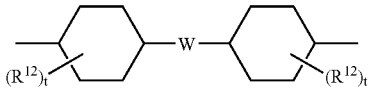

-continued (16)

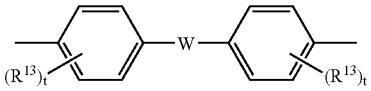

In formulas (9) to (16), $R^{12}$ and $R^{13}$ each represent a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; W represents a divalent group; q and r each represents an integer of 1 to 10; and t represents an integer of 1 to 3.

W in the above-mentioned formulas (15) and (16) may be any one of divalent groups represented by the following formulas (17) to (25):

$$—CH_2— \quad (17)$$

$$—C(CH_3)_2— \quad (18)$$

$$—O— \quad (19)$$

$$—S— \quad (20)$$

$$—C(CF_3)_2— \quad (21)$$

$$—Si(CH_3)_2— \quad (22)$$

(23)

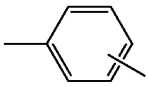

(24)

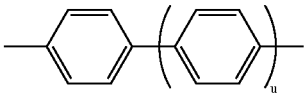

(25)

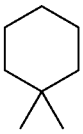

In formula (24), u represents an integer of 0 to 3.

Further, in general formula (5), $Ar^5$ is the aryl group illustrated in the description of $Ar^1$ to $Ar^4$, when k is 0, and an arylene group obtained by removing a certain hydrogen atom from such an aryl group, when k is 1.

Combinations of $Ar^1$, $Ar^2$, $Ar^3$, $Ar^4$, $Ar^5$ and integer k in formula (5) and a group represented by $-D-SiR_{3-a}Q_a$ in general formula (2) in particular exemplary embodiments are shown in Table 2; additional exemplary embodiments can be found in US 2004/0086794 and U.S. Pat. No. 6,730,448 B2, incorporated herein by reference in their entireties. In Table 2, S represents $-D-SiR_{3-a}Q_a$ linked to $Ar^1$ to $Ar^5$, Me represents a methyl group, Et represents an ethyl group, and Pr represents a propyl group.

TABLE 2
| No. | $Ar^1$ | $Ar^2$ | $Ar^3$ & $Ar^4$ | $Ar^5$ | k | —S |
|---|---|---|---|---|---|---|
| II-1 | 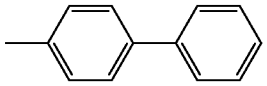 | 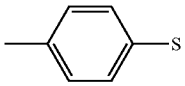 | — | 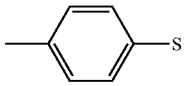 | 0 | $—(CH_2)_2—COO—(CH_2)_3—Si(O^iPr)_3$ |
| II-2 | 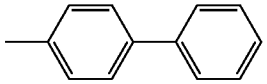 | 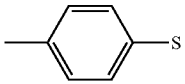 | — | 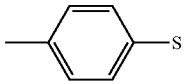 | 0 | $—(CH_2)_2—COO—(CH_2)_3—SiMe(O^iPr)_2$ |
| II-3 | 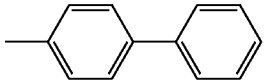 | 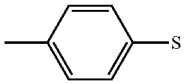 | — | 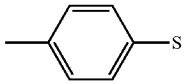 | 0 | $—(CH_2)_2—COO—(CH_2)_3—SiMe_2(O^iPr)$ |
| II-4 | 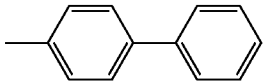 | 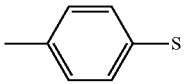 | — | 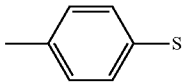 | 0 | $—COO—(CH_2)_3—Si(O^iPr)_3$ |
| II-5 | 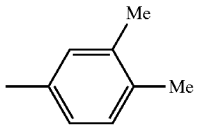 | 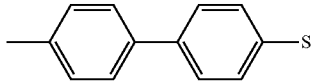 | — | 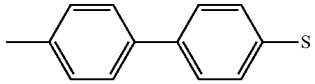 | 0 | $—(CH_2)_2—COO—(CH_2)_3—Si(O^iPr)_3$ |
| II-6 | 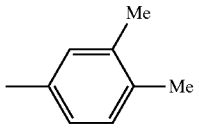 | 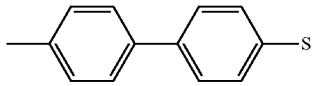 | — | 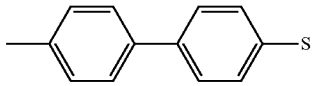 | 0 | $—(CH_2)_2—COO—(CH_2)_3—SiMe(O^iPr)_2$ |
| II-7 | 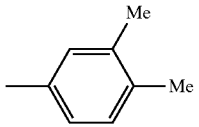 | 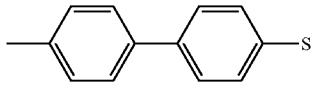 | — | 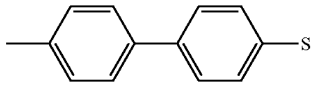 | 0 | $—(CH_2)_2—COO—(CH_2)_3—SiMe_2(O^iPr)$ |
| II-8 | 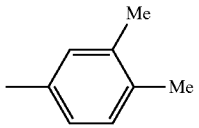 | 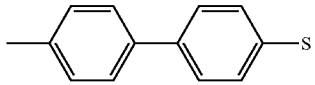 | — | 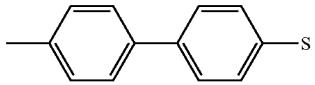 | 0 | $—COO—(CH_2)_3—Si(O^iPr)_3$ |

TABLE 2-continued
| No. | $Ar^1$ | $Ar^2$ | $Ar^3$ & $Ar^4$ | $Ar^5$ | k | —S |
|---|---|---|---|---|---|---|
| II-9 | 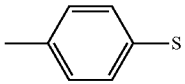 | 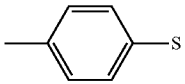 | — | 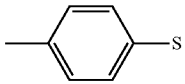 | 0 | $—(CH_2)_2—COO—(CH_2)_3—Si(O^iPr)_3$ |
| II-10 | 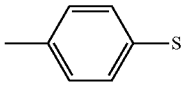 | 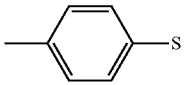 | — | 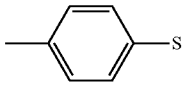 | 0 | $—(CH_2)_2—COO—(CH_2)_3—SiMe(O^iPr)_2$ |
| II-11 | 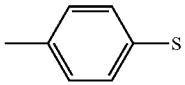 | 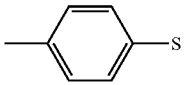 | — | 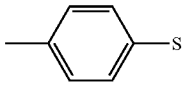 | 0 | $—(CH_2)_2—COO—(CH_2)_3—SiMe_2(O^iPr)$ |
| II-12 | 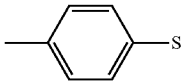 | 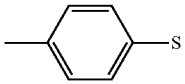 | — | 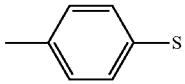 | 0 | $—COO—(CH_2)_3—Si(O^iPr)_3$ |
| II-13 | 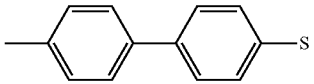 | 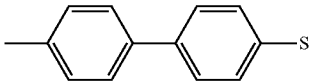 | — | 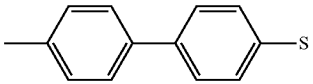 | 0 | $—(CH_2)_2—COO—(CH_2)_3—Si(O^iPr)_3$ |
| II-14 | 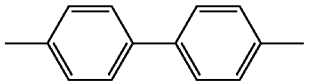 | 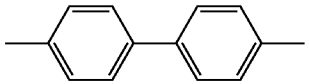 | — | 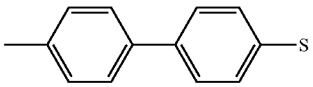 | 0 | $—(CH_2)_2—COO—(CH_2)_3—SiMe(O^iPr)_2$ |
| II-15 | 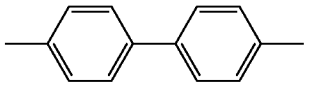 | 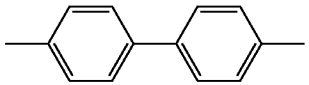 | — | 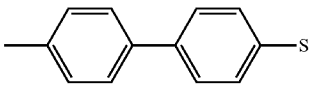 | 0 | $—(CH_2)_2—COO—(CH_2)_3—SiMe_2(O^iPr)$ |
| II-16 | 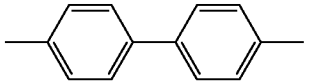 | 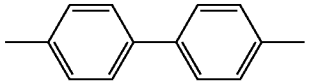 | — | 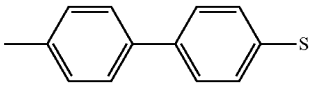 | 0 | $—COO—(CH_2)_3—Si(O^iPr)_3$ |

Further, in embodiments, the silicon-containing compounds represented by the above-mentioned general formula (3) may include silane coupling agents, such as a tetrafunctional alkoxysilane (c=4), such as tetramethoxysilane or tetraethoxysilane; a trifunctional alkoxysilane (c=3), such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl) trimethoxysilane, 3-(heptafluoroisopropoxy)propyltriethoxysilane,1H, 1H,2H,2H-perfluoroalkyltriethoxysilane, 1H,1H,2H,2H-perfluorodecyltriethoxysilane or 1H,1H,2H,2H-perfluorooctyltriethoxysilane; a bifunctional alkoxysilane (c=2), such as dimethyldimethoxysilane, diphenyldimethoxysilane or methylphenyldimethoxysilane; and a monofunctional alkoxysilane (c=1), such as trimethylmethoxysilane.

In order to improve the strength of the photosensitive layer, the trifunctional alkoxysilanes and the tetrafunctional alkoxysilanes may be used in embodiments, and in order to improve the flexibility and film-forming properties, the monofunctional alkoxysilanes and the bifunctional alkoxysilanes may be used in embodiments.

Silicone hard-coating agents containing such coupling agents can also be used in embodiments. Commercially available hard-coating agents include KP-85, X-40-9740 and X-40-2239 (available from Shinetsu Silicone Co., Ltd.), and AY42-440, AY42-441 and AY49-208 (available from Toray Dow Corning Co., Ltd.).

In embodiments, the silicon-containing layer may contain either only one of the silicon-containing compounds represented by the above-mentioned general formulas (1) to (3) or two or more of them. Further, the compounds represented by general formulas (1) to (3) may include a monofunctional compound (a compound in which a or c is 1), a bifunctional compound (a compound in which a or c is 2), a trifunctional compound (a compound in which a or c is 3) and/or a tetrafunctional compound (a compound in which a or c is 4). However, in particular embodiments, the number of silicon atoms derived from the silicon-containing compounds represented by the above-mentioned general formulas (1) to (3) in the silicon-containing layer satisfies the following equation (26):

$$(N_{a=3}+N_{c\geqq 3})/N_{total}\leqq 0.5 \quad (26)$$

wherein $N_{a=3}$ represents the number of silicon atoms derived from $—SiR_{3-a}Q_a$ of the silicon-containing compound represented by general formula (1) or (2), in which a is 3; $N_{c\geqq 3}$ represents the number of silicon atoms derived from the silicon-containing compound represented by general formula (3) in which c is 3 or 4; and $N_{total}$ represents the total of the number of silicon atoms derived from $—SiR_{3-a}Q_a$ of the silicon compound represented by general formula (1) or (2) and the number of silicon atoms derived from the silicon-containing compound represented by general formula (3). That is to say, the ratio of silicon-containing compounds contained is set so that the number of silicon atoms derived from the trifunctional compound or the tetrafunctional compound becomes 0.5 or less based on the number of silicon atoms derived from the silicon-containing compounds represented by general formulas (1) to (3) (in the case of the compound represented by general formula (1) or (2), the silicon atoms are limited to ones derived from $—SiR_{3-a}Q_a$, and the same applies hereinafter). When the value of the left side of equation (26) exceeds 0.5, an indistinct image tends to be liable to occur at high temperature and high humidity. When the value of the left side of equation (26) is decreased, a decrease in strength may also result. However, the use of a silicon-containing compound having two or more silicon atoms in its molecule can improve the strength.

In embodiments, the metal oxide particles are selected from aluminum oxide, silcon oxide, titanium oxide, cerium oxide and zirconium oxide particles, preferably aluminum oxide particles. In various embodiments, combinations of one or more different metal oxide particles are used together. In various embodiments, the metal oxide particles are selected from the commercially-available alumina. For example, suitable commercially-available alumina is produced by Nanophase with trade name of NanoTek® alumina.

In embodiments, the metal oxide particles are spherical particles with non-porous, highly crystalline of at least 50 percent of γ-type crystalline structure, high surface area and high chemically purity. Upon dispersal in a polymer binder, the metal oxide particles have extremely high surface area to unit volume ratio, and thus have a larger interaction zone with the dispersing medium.

In embodiments, the metal oxide particles have an average particle size of from about 1 to about 250 nm, from about 1 to about 199 nm, from about 1 to about 195 nm, from about 1 to about 175 nm, from about 1 to about 150 nm, from about 1 to about 100 nm, or from about 1 to about 50 nm.

In embodiments, the metal oxide particles are present in an amount of about 2% to about 20% of the total weight of the overcoat layer, in an amount of about 5% to about 20%, in an amount of about 2% to about 10%, in an amount of about 5% to about 10%, or in an amount of about 2% to about 5% of the total weight of the overcoat layer.

The inventors have discovered that when the metal oxide particles are present in an amount of less than about 2%, the presence of the metal oxide particles in the silicon hard overcoat has only a minor effect on the wear rate of the coated photoreceptor, on image quality, and/or on electric properties. The inventors have also discovered that when the metal oxide particles are present in an amount of greater than about 20%, the presence of the metal oxide particles in the silicon hard overcoat has a negative effect on image quality, and/or on electric properties.

In embodiments, the metal oxide particles are prepared by plasma synthesis or vapor phase synthesis, resulting in very high purity and very low porosity. The inventors have discovered that metal oxide particles prepared by plasma synthesis or vapor phase synthesis are spherical-shaped or crystalline-shaped and are less likely to absorb and trap electric charges. The inventors have also discovered that γ-Type crystalline metal oxide particles contain more Lewis acid sites than other type particles and therefore offer low residual potential to the coated photoreceptor. In contrast to particles prepared by other methods (e.g., hydrolytic methods), the metal oxide particles prepared by plasma synthesis or vapor phase synthesis are non-porous, as evidenced by their relatively low BET values.

"BET" refers to the Brunauer, Emmett and Teller method for measuring the surface area of fine particles. The BET theory and the measurement method can be found in Webb Orr, *Analytical Methods in Fine Particles Technology,* 1997. The BET method can be used to determine the porosity of a photoreceptor by measuring the amount of $N_2$ gas absorbed by the photoreceptor. Under the BET method, an increase in surface area corresponds to the presence of an increased porosity.

In embodiments, the metal oxide particles of the invention have a BET value of less than about 200 $m^2/g$, such as from about 1 $m^2/g$ to about 75 $m^2/g$, from about 20 $m^2/g$ to about 40 $m^2/g$, or about 42 $m^2/g$.

In embodiments, the resin is soluble in a liquid component, and is selected depending on the kind of liquid component. For example, when the coating solution contains an alcoholic solvent (such as methanol, ethanol or butanol), a polyvinyl acetal resin such as a polyvinyl butyral resin, a polyvinyl formal resin or a partially acetalized polyvinyl acetal resin in which butyral is partially modified with formal or acetoacetal, a polyamide resin, a cellulose resin such as ethyl cellulose and a phenol resin are available as the alcohol-soluble resins. These resins may be used either alone or as a combination of two or more of them. Of the above-mentioned resins, the polyvinyl acetal resin is preferred in terms of electric characteristics.

The weight-average molecular weight of the resin is preferably from about 2,000 to about 1,000,000, and more preferably from about 5,000 to about 50,000. When the average molecular weight is less than 2,000, the effect of enhancing discharge gas resistance, mechanical strength, scratch resistance, particle dispersibility, etc. tends to become insufficient. On the other hand, when the average molecular weight exceeds 1,000,000, the solubility of the resin in the coating solution decreases, contributing to poor film formation.

Further, the amount of the resin soluble in the liquid component is preferably from about 0.1 to about 15% by weight, and more preferably from about 0.5 to about 10% by weight, based on the total amount of the coating solution. When the amount added is less than 0.1% by weight, the effect of enhancing discharge gas resistance, mechanical strength, scratch resistance, particle dispersibility, etc. becomes insufficient. On the other hand, exceeding 15% by weight results in an indistinct image when the electrophotographic photoreceptor of the invention is used at high temperature and high humidity.

As used herein, a "high temperature environment" or "high temperature conditions" refer to an atmosphere in which the temperature is at least 28° C. A "high humidity environment" or "high humidity conditions" refer to an atmosphere in which the relative humidity is at least 75%.

There is no particular limitation on the siloxane-containing compound used in the invention, as long as it has at least one silicon atom. However, a compound having two or more silicon atoms in its molecule is preferably used. The use of the compound having two or more silicon atoms allows both the strength and image quality of the electrophotographic photoreceptor to be achieved at higher levels.

In addition to the metal oxide particles of the invention, various fine particles can also be added to the silicon hard overcoat layer. The fine particles may be used either alone or as a combination of two or more of them. Examples of the fine particles include fine particles containing silicon. The fine particles containing silicon are fine particles containing silicon as a constituent element, and specifically include colloidal silica and fine silicone particles. Other fine particles include fine fluorine-based particles such as ethylene tetrafluoride, ethylene trifluoride, propylene hexafluoride, vinyl fluoride and vinylidene fluoride, and semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

In embodiments, an additive such as a plasticizer, a surface modifier, an antioxidant or an agent for preventing deterioration by light can also be used in the overcoat layer. Acceptable plasticizers include, for example, biphenyl, biphenyl chloride, terphenyl, dibutyl phthalate, diethylene glycol phthalate, dioctyl phthalate, triphenylphosphoric acid, methylnaphthalene, benzophenone, chlorinated paraffin, polypropylene, polystyrene and various fluorohydrocarbons.

In a first embodiment, the crosslinked siloxane composite overcoat is made by preparing a homogenized silicon hard overcoat matrix, for example as disclosed in U.S. Patent Application Publication No. US 2004/0086794 A1. The metal oxide particles prepared by plasma synthesis or vapor phase synthesis, as discussed above, are then blended with the homogenized matrix to form the crosslinked siloxane composite overcoat. Alternatively, in a second embodiment, the metal oxide particles are added to the components of the overcoat before homogenization, and the crosslinked siloxane composite overcoat is then made by preparing a homogeneous matrix of the entire mixture. The overcoat is then coated onto the photoreceptor, for example as disclosed in U.S. Patent Application Publication No. US 2004/0086794 A1. In embodiments, the photoreceptor is coated using a sol gel coating method.

Photoreceptor

The electrophotographic photoreceptor of the invention may be either a function-separation type photoreceptor, in which a layer containing a charge generation substance (charge generation layer) and a layer containing a charge transfer substance (charge transfer layer) are separately provided, or a single layer type photoreceptor in which both the charge generation layer and the charge transfer layer are contained in the same layer.

FIG. 1 is a cross sectional view schematically showing an embodiment of the electrophotographic photoreceptor of the invention. The electrophotographic photoreceptor 1 shown in FIG. 1 is a photoreceptor in which a charge generation layer 13 and a charge transfer layer 14 are separately provided. That is to say, an underlayer 12, the charge generation layer 13, the charge transfer layer 14 and a protective layer 15 are laminated in this order on a conductive support 11. Of these, the protective layer 15 contains the overcoat.

The conductive support 11 includes, for example, a metal plate, a metal drum or a metal belt using a metal such as aluminum, copper, zinc, stainless steel, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment such as anodic oxidation coating, hot water oxidation, chemical treatment, coloring or diffused reflection treatment such as graining can also be applied to a surface of the support 11.

Binding resins used in the underlayer 12 include, specifically, a polyamide resin, a vinyl chloride resin, a vinyl acetate resin, a phenol resin, a polyurethane resin, a melamine resin, a benzoguanamine resin, a polyimide resin, a polyethylene resin, a polypropylene resin, a polycarbonate resin, an acrylic resin, a methacrylic resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, polyglutamic acid, starch, starch acetate, amino starch, polyacrylic acid, polyacrylamide, a zirconium chelate compound, a titanyl chelate compound, a titanyl alkoxide compound, an organic titanyl compound and a silane coupling agent. These can be used either alone or as a combination of two or more of them. Further, fine particles of titanium oxide, aluminum oxide, silicon oxide, zirconium oxide, barium titanate, a silicone resin or the like may be added to the above-mentioned binding resin.

As a coating method in forming the underlayer, an ordinary method such as blade coating, Mayer bar coating, spray coating, dip coating, bead coating, air knife coating or curtain coating is employed. In embodiments, the thickness of the underlayer is from 0.01 to 40 μm.

The charge generation substances contained in the charge generation layer 13 include, for example, various organic pigments and organic dyes such as an azo pigment, a quinoline pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye; and inorganic materials such as amorphous silicon, amorphous selenium, tellurium, a selenium-tellurium alloy, cadmium sulfide, antimony sulfide, zinc oxide and zinc sulfide. Of these, the cyclocondensed aromatic pigments, the perylene pigment and the azo pigment are preferred in terms of sensitivity, electric stability and photochemical stability against irradiated light. These charge generation substances may be used either alone or as a combination of two or more of them.

The charge generation layer 13 is formable by vacuum deposition of the charge generation substance or application of a coating solution in which the charge generation substance is dispersed in an organic solvent containing a binding resin. The binding resins used in the charge generation layer include a polyvinyl acetal resin such as a polyvinyl butyral resin, a polyvinyl formal resin or a partially acetalized polyvinyl acetal resin in which butyral is partially modified with formal or acetoacetal, a polyamide resin, a polyester resin, a modified ether type polyester resin, a polycarbonate resin, an acrylic resin, a polyvinyl chloride resin, a polyvinylidene chloride, a polystyrene resin, a polyvinyl acetate resin, a vinyl chloride-vinyl acetate copolymer, a silicone resin, a phenol resin, a phenoxy resin, a melamine resin, a benzoguanamine resin, a urea resin, a polyurethane resin, a poly-N-vinylcarbazole resin, a polyvinylanthracene resin and a polyvinylpyrene resin. These can be used either alone or as a combination of two or more of them.

Of these, when the polyvinyl acetal resin, the vinyl chloride-vinyl acetate copolymer, the phenoxy resin or the modified ether type polyester resin is used, the dispersibility of the charge generation substance is improved to cause no occurrence of coagulation of the charge generation substance, thereby obtaining the coating solution stable for a long period of time. The use of such a coating solution makes it possible to form a uniform coating easily and surely. As a result, the electric characteristics are improved, thereby being able to sufficiently prevent the occurrence of an image defect. In embodiments, the compounding ratio of the charge generation substance to the binding resin is within the range of 5:1 to 1:2 by volume ratio.

Further, the solvents used in preparing the coating solution include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform. These can be used either alone or as a mixture of two or more of them.

Methods for applying the coating solution include the coating methods exemplified in the description of the above-mentioned underlayer.

Further, a stabilizer such as an antioxidant or an inactivating agent can also be added to the charge generation layer 13. The antioxidants include, for example, antioxidants such as phenolic, sulfur, phosphorus and amine compounds. The inactivating agents include bis(dithiobenzyl)nickel and nickel di-n-butylthiocarbamate.

The charge transfer layer 14 can be formed by applying a coating solution containing the charge transfer substance and a binding resin, and further fine particles, an additive, etc., as described above.

The low molecular weight charge transfer substances include, for example, pyrene, carbazole, hydrazone, oxazole, oxadiazole, pyrazoline, arylamine, arylmethane, benzidine, thiazole, stilbene and butadiene compounds. Further, the high molecular weight charge transfer substances include, for example, poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane. Of these, the triphenylamine compound, the triphenylmethane compound and the benzidine compound are preferred in terms of mobility, stability and transparency to light.

As the binding resin, a high molecular weight polymer which can form an electrical insulating film is preferred. For example, when the polyvinyl acetal resin, the polyamide resin, the cellulose resin, the phenol resin, etc., which are the resins soluble in the alcoholic solvents, are used, the binding resins used together with these resins include a polycarbonate, a polyester, a methacrylic resin, an acrylic resin, polyvinyl chloride, polyvinylidene chloride, polystyrene, polyvinyl acetate, a styrene-butadiene copolymer, a vinylidene chloride-acrylonitrile copolymer, a vinyl chloride-vinyl acetate copolymer, vinyl chloride-vinyl acetate-maleic anhydride copolymer, a silicone resin, a silicone-alkyd resin, a phenol-formaldehyde resin, a styrene-alkyd resin, poly-N-vinylcarbazole, polyvinyl butyral, polyvinyl formal, a polysulfone, casein, gelatin, polyvinyl alcohol, a phenol resin, a polyamide, carboxymethyl cellulose, a vinylidene chloride-based polymer latex and a polyurethane. Of the above-mentioned high molecular weight polymers, the polycarbonate, the polyester, the methacrylic resin and the acrylic resin are preferred, because they are excellent in compatibility with the charge transfer substance, solubility in the solvent and strength.

The charge transfer layer 14 may further contain an additive such as a plasticizer, a surface modifier, an antioxidant or an agent for preventing deterioration by light.

The protective layer 15 contains the resin soluble in the liquid component in the coating solution used for formation of the protective layer, the silicon compound and the metal oxide particles. The protective layer 15 may further contain a lubricant or fine particles of a silicone oil or a fluorine material, which can also improve lubricity and strength. Preferred examples of the lubricants include the above-mentioned fluorine-based silane coupling agents. In embodiments, the thickness of the protective layer is from 0.1 to 10 μm, from 0.5 to 7 μm, or from 1.5 to 3.5 μm.

Image Forming Apparatus and Process Cartridge

In embodiments, a non-contact charging system (e.g., a corotron charger) or a contact charging device, an exposure device, a developing device, a transfer device and a cleaning unit are arranged along the rotational direction of the above-described electrophotographic photoreceptor. In various embodiments, this apparatus is equipped with an image fixing device, and a medium to which a toner image is to be transferred is conveyed to the image fixing device through the transfer device.

In embodiments, the contact charging device has a roller-shaped contact charging member. The contact charging member is arranged so that it comes into contact with a surface of the photoreceptor, and a voltage is applied, thereby being able to give a specified potential to the surface of the photoreceptor. As a material for such a contact charging member, there can be used a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Examples of the metal oxides include ZnO, $SnO_2$, $TiO_2$, $In_2O_3$, $MoO_3$ and a complex oxide thereof. Further, a perchlorate may be added to the elastomer material to impart conductivity.

In embodiments, a covering layer can also be provided on a surface of the contact charging member. Materials for forming this covering layer include N-alkoxymethylated nylon, a cellulose resin, a vinylpyridine resin, a phenol resin, a polyurethane, polyvinyl butyral and melamine, and these may be used either alone or as a combination of two or more of them. Furthermore, an emulsion resin material such as an acrylic resin emulsion, a polyester resin emulsion or a polyurethane, particularly an emulsion resin synthesized by soap-free emulsion polymerization can also be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant can also be added to the emulsion resin.

In embodiments, the resistance of the contact charging member is from $10^0$ to $10^{14}$ Ωcm, or from $10^2$ to $10^{12}$ Ωcm. When a voltage is applied to this contact charging member, either a DC voltage or an AC voltage can be used as the applied voltage. Further, a superimposed voltage of a DC voltage and an AC voltage can also be used. Such a contact charging member may be in the shape of a blade, a belt, a brush or the like.

In embodiments, the exposure device can be an optical device which can perform desired imagewise exposure to a surface of the electrophotographic photoreceptor 1 with a light source such as a semiconductor laser, an LED (light emitting diode) or a liquid crystal shutter. In various embodiments, the use of the exposure device makes it possible to perform exposure to noninterference light.

In embodiments, the developing device can be a known or later used developing device using a normal or reversal developing agent of a one-component system, a two-component system or the like. There is no particular limitation on the shape of a toner used, and for example, an irregularly shaped toner obtained by pulverization or a spherical toner obtained chemical polymerization is suitably used.

In embodiments, the transfer device can be a contact type transfer charging device using a belt, a roller, a film, a rubber blade or the like, or a scorotron transfer charger or a corotron transfer charger utilizing corona discharge.

In embodiments, the cleaning device can be a device for removing a remaining toner adhered to the surface of the electrophotographic photoreceptor after a transfer step, and the electrophotographic photoreceptor cleaned up thereby is repeatedly subjected to the above-mentioned image formation process. As the cleaning device, there can be used a cleaning blade, a cleaning brush, a cleaning roll or the like. In embodiments, a cleaning blade is used. Materials for the cleaning blade include urethane rubber, neoprene rubber and silicone rubber.

In various embodiments, the respective steps of charging, exposure, development, transfer and cleaning are conducted in turn in the rotation step of the electrophotographic photoreceptor, thereby repeatedly performing image formation.

Here, the electrophotographic photoreceptor is provided with the overcoat layer. Accordingly, even when the photoreceptor is used together with the contact charging device or the cleaning blade, or further with the spherical toner obtained by chemical polymerization, good image quality can be obtained with a good wear rate and no adverse effects on electric properties of the photoreceptor.

In embodiments, an intermediate transfer belt is supported with a driving roll, a backup roll and a tension roll at a specified tension, and rotatable by the rotation of these rolls without the occurrence of deflection. Further, a secondary transfer roll can be arranged so that it is brought into abutting contact with the backup roll through the intermediate transfer belt. The intermediate transfer belt which has passed between the backup roll and the secondary transfer roll is cleaned up by a cleaning blade, and then repeatedly subjected to the subsequent image formation process.

The invention should not be construed as being limited to the above-mentioned embodiments. For example, in embodiments the image forming apparatus can be equipped with a process cartridge comprising the electrophotographic photoreceptor(s) and charging device(s). The use of such a process cartridge allows maintenance to be performed more simply and easily.

Furthermore, in embodiments, a toner image formed on the surface of the electrophotographic photoreceptor can be directly transferred to the medium to which the toner image is to be transferred. However, in various embodiments, the image forming apparatus of the invention may be further provided with an intermediate transfer body. This makes it possible to transfer the toner image from the intermediate transfer body to the medium to which the toner image is to be transferred, after the toner image on the surface of the electrophotographic photoreceptor has been transferred to the intermediate transfer body. In embodiments, the intermediate transfer body can have a structure in which an elastic layer containing a rubber, an elastomer, a resin or the like and at least one covering layer are laminated on a conductive support.

In addition, in embodiments, the image forming apparatus of the invention may be further equipped with a static eliminator such as an erase light irradiation device. This prevents the phenomenon of incorporating the residual potential of the electrophotographic photoreceptor into the subsequent cycle, when the electrophotographic photoreceptor is repeatedly used. Accordingly, image quality can be more improved.

Examples are set forth herein below and is illustrative of embodiments of the present invention. It will be apparent, however, that the invention can be practiced with many types of compositions and can have many different uses in accordance with the disclosure above and as pointed out hereinafter.

EXAMPLES

A conventional overcoat is prepared as Comparative Example 1, and embodiments of overcoats according to the invention are prepared as Examples 1-3. Specifically, the overcoats are prepared according to the following formula, in parts by weight, as outlined in Table 1:

TABLE 1

| Component | Comparative Example 1 (parts by weight) | Example 1 (parts by weight) | Example 2 (parts by weight) | Example 3 (parts by weight) |
|---|---|---|---|---|
| Compound II-2 | 2.2 | 2.2 | 2.2 | 2.2 |
| Compound I-3 | 1.2 | 1.2 | 1.2 | 1.2 |
| hexamethylcyclotrisiloxane | 0.2 | 0.2 | 0.2 | 0.2 |
| poly(vinyl butyral) | 0.4 | 0.4 | 0.4 | 0.4 |
| 2,6-Di-tert-butyl-4-methylphenol | 0.036 | 0.036 | 0.036 | 0.036 |
| aluminum acetylacetonate | 0.036 | 0.036 | 0.036 | 0.036 |
| Acetylacetone | 0.036 | 0.036 | 0.036 | 0.036 |
| 1-butanol | 6.4 | 6.4 | 6.4 | 6.4 |
| Alumina particles | 0 | 0.205 | 0.411 | 0.822 |

Comparative Example 1

2.2 parts of compound II-2, 1.2 parts of compound I-3, 0.2 part of hexamethylcyclotrisilane, and 2.2 parts of methanol were mixed, and 0.25 parts of an ion exchange resin (AMBERLIST H15) was added thereto, followed by stirring for 3 hours. Furthermore, 6.4 parts of butanol and 1 parts of distilled water were added to this mixture, followed by stirring at room temperature for 30 minutes. Then, the resulting mixture was filtered to remove the ion exchange resin, and 0.036 parts of aluminum trisacetylacetonate ($Al(AcAC)_3$), 0.036 parts of acetylacetone (AcAc), 0.4 parts of a polyvinyl butyral resin (trade name: S-LEC KW-1, manufactured by Sekisui Chemical Co., Ltd.), and 0.036 parts of butylated-hydroxytoluene (BHT) were added to a filtrate obtained, and thoroughly dissolved therein for 2 hours to obtain a coating solution for a protective layer. This coating solution was applied onto the above-mentioned charge transfer layer by dip coating (coating speed: about 170 mm/min), and dried by heating at 130° C. for one hour to form the protective layer having a film thickness of 3 μm, thereby obtaining a desired electrophotographic photoreceptor.

The overcoats are coated onto a photoreceptor drum by a ring coating technique. The electric properties, the torque properties and the wear properties of the photoreceptor are evaluated, and the results are presented in FIGS. 2-3 and Table 3, respectively.

Embodiments of crosslinked siloxane composite overcoats are prepared as in the Comparative Example 1, except that various amounts of alumina are blended into the overcoat layer. Specifically, in Example 1, alumina in the amount of 5% of the total weight of the overcoat layer is added; in Example 2, alumina in the amount of 10% of the total weight of the overcoat layer is added; and in Example 3, alumina in the amount of 20% of the total weight of the overcoat layer is added.

Electrical and Wear Testing

The xerographic electrical properties of the above prepared photoconductive imaging member and other similar members can be determined by known means, including electrostatically charging the surfaces thereof with a corona discharge source until the surface potentials, as measured by a capacitively coupled probe attached to an electrometer, attained an initial value Vo of about −800 volts. After resting for 0.5 second in the dark, the charged members attained a surface potential of Vddp, dark development potential. Each member was then exposed to light from a filtered Xenon lamp thereby inducing a photodischarge which resulted in a reduction of surface potential to a Vbg value, background potential. The percent of photodischarge was calculated as 100×(Vddp−Vbg)/Vddp. The desired wavelength and energy of the exposed light was determined by the type of filters placed in front of the lamp. The monochromatic light photosensitivity was determined using a narrow band-pass filter. The photosensitivity of the imaging member is usually provided in terms of the amount of exposure energy in ergs/cm$^2$, designated as $E_{1/2}$, required to achieve 50 percent photodischarge from Vddp to half of its initial value. The higher the photosensitivity, the smaller is the $E_{1/2}$ value. The $E_{7/8}$ value corresponds to the exposure energy required to achieve ⅞ photodischarge from Vddp. The device was finally exposed to an erase lamp of appropriate light intensity and any residual potential (Vresidual) was measured. The imaging members were tested with an monochromatic light exposure at a wavelength of 780+/−10 nanometers and an erase light with the wavelength of 600 to 800 nanometers and intensity of 200 ergs.cm$^2$.

The devices were then mounted on a wear test fixture to determine the mechanical wear characteristics of each device. Photoreceptor wear was determined by the change in thickness of the photoreceptor before and after the wear test. The thickness was measured, using a permascope at one-inch intervals from the top edge of the coating along its length using a permascope, ECT-100. All of the recorded thickness values are averaged to obtain the average thickness of the entire photoreceptor device. For the wear test the photoreceptor was wrapped around a drum and rotated at a speed of 140 rpm. A polymeric cleaning blade is brought into contact with the photoreceptor at an angle of 20 degrees and a force of approximately 60-80 grams/cm. Single component toner is trickled on the photoreceptor at rate of 200 mg/min. The drum is rotated for 150 kcycle during a single test. The wear rate is equal to the change in thickness before and after the wear test divided by the # of kcycles.

Figure 2:
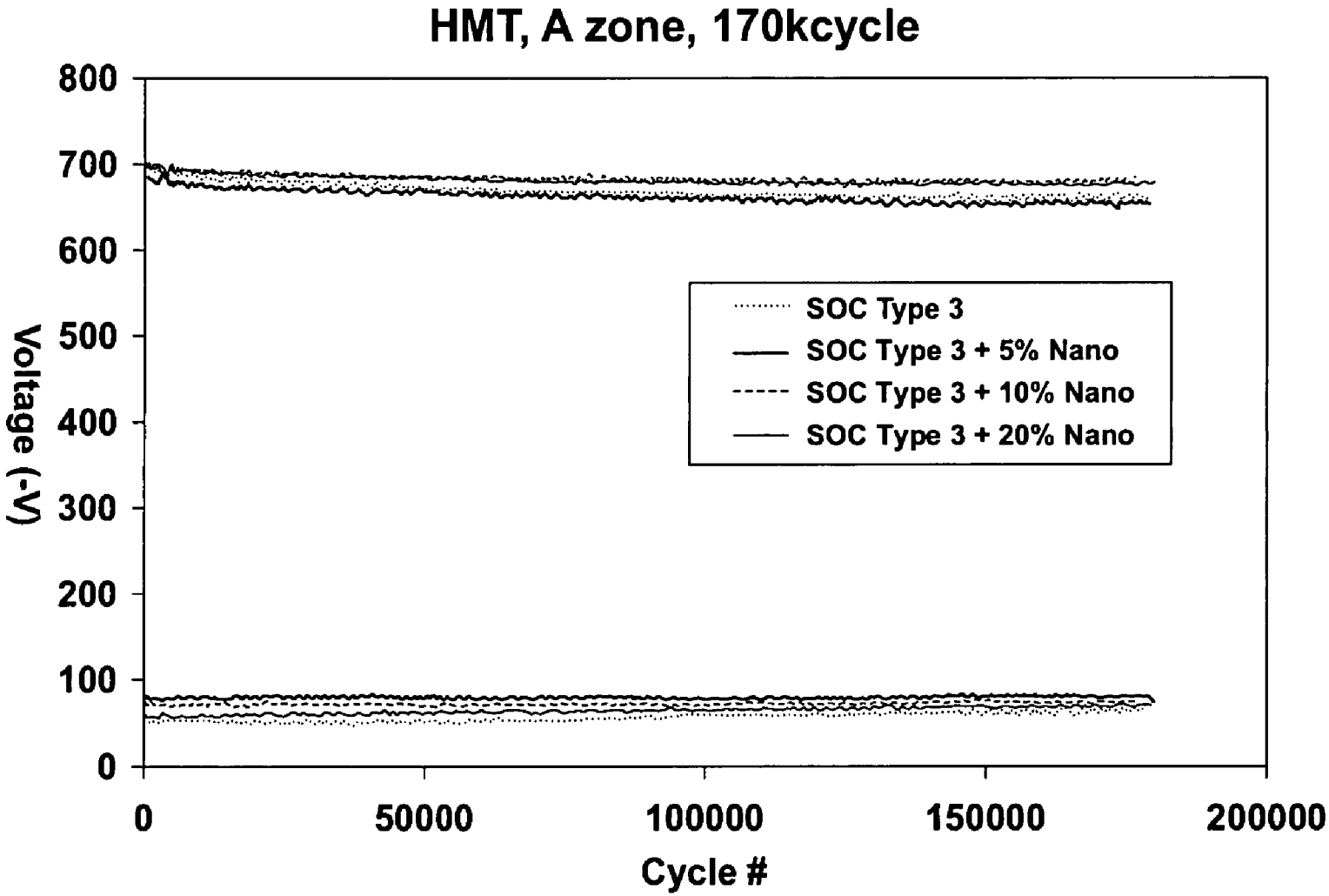
FIG. 2 is graph illustrating a comparison of the electric properties of various overcoat layers.

As can be seen in FIG. 2, the charge electric properties (top lines) and the erase electric properties (bottom lines) of the photoreceptors of Examples 1-3 do not significantly vary from the electric properties of the photoreceptor of the Comparative Example 1. Accordingly, the electric properties of photoreceptors containing the crosslinked siloxane composite overcoat layers are not adversely affected by the presence of about 2% to about 5% alumina in the protective layer.

Torque Fixture Procedure

The photoreceptor drum is mounted in a xerographic cartridge. The xerographic cartridge containing a photoreceptor drum, a cleaning blade, and charging unit is loaded into the appropriate xerographic machine and 10 pages at 10% area coverage are printed. The objective for printing the pages is to ensure the cleaning blade-photoreceptor contact area is lubricated with toner. The xerographic cartridge is removed from the xerographic machine and mounted in a torque fixture. The torque fixture is comprised of a high torque motor, a rotary torque transducer, the appropriate coupler to the xerographic cartridge and computer for controlling the experiment. Prior to commencing the experiment a toner lubrication strip is applied to the surface of the photoreceptor drum. The objective is to provide more lubrication for the cleaning blade-photoreceptor interaction. To measure torque the drum is rotated, against the cleaning blade, for 10 cycles at constant rpm. The maximum torque, typically the starting torque is recorded. The xerographic module is then removed from the torque fixture and remounted in the xerographic machine. The entire process is repeated a total of three times and the average value is recorded.

Figure 3:
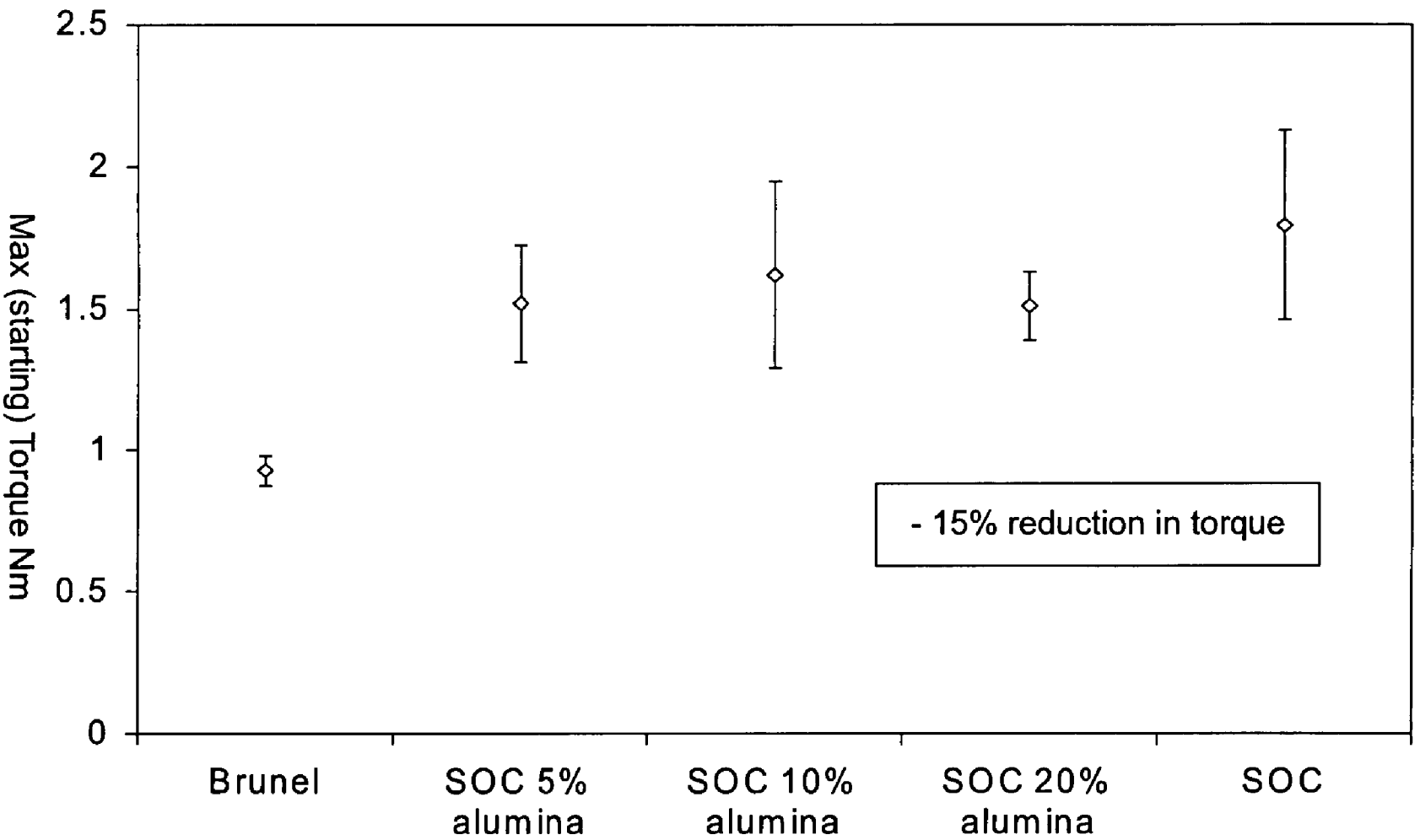
FIG. 3 is a graph illustrating a comparison of the torque properties of various overcoat layers.

As can be seen in FIG. 3, the required amount of torque (measure of interaction between surface of photoreceptor and the cleaning blade) of the photoreceptors of Examples 1-3 is reduced by about 15% as compared to that of the photoreceptor of the Comparative Example 1. Accordingly, the torque properties of photoreceptors containing the crosslinked siloxane composite overcoat layers are improved by the presence of about 2% to about 5% alumina in the protective layer.

As can be seen in Table 3, the wear rate of the photoreceptors of Examples 1-3 are improved as compared to that of the photoreceptor of the Comparative Example 1. As a result, the loss of thickness of the photoreceptors of Examples 1-3 is less than that of the photoreceptor of the Comparative Example 1.

TABLE 3

| | Beginning Thickness (μm) | # of Cycles (in thousands) | Wear Rate (nm/thousand cyles) | Thickness Lost (μm) | Ending Thickness (μm) |
|---|---|---|---|---|---|
| Comparative Example 1 | 3.4 | 150 | 13 | 2 | 1.4 |
| Example 1 (5% Alumina) | 3 | 150 | 9.7 | 1.5 | 1.5 |
| Example 2 (10% Alumin) | 2.9 | 150 | 4.1 | 0.6 | 2.3 |
| Example 3 (20% Alumina) | 2.7 | 150 | 2.5 | 0.4 | 2.3 |

Accordingly, the wear properties of photoreceptors containing the crosslinked siloxane composite overcoat layers are improved by the presence of about 2% to about 5% alumina in the protective layer.

While this invention has been described in conjunction with the embodiments set forth above, it is evident that many alternatives, modifications and variations will be apparent to those skilled in the art. Accordingly, the embodiments of the invention set forth above are intended to be illustrative and not limiting. Various changes may be made without departing from the spirit and the scope of the invention as defined in the following claims.

What is claimed is:

1. An electrophotographic photoreceptor comprising a charge generating layer, a charge transport layer, and an overcoat layer comprised of a crosslinked siloxane composite composition comprising at least one siloxane-containing compound and metal oxide particles, wherein the metal oxide particles are non-porous and 50 percent of the metal oxide particles have a γ-type crystalline structure.

2. The electrophotographic photoreceptor of claim 1, wherein the metal oxide particles are prepared by plasma synthesis or vapor phase synthesis.

3. The electrophotographic photoreceptor of claim 1, wherein said metal oxide particles are at least one member selected from the group consisting of aluminum oxide, silicon oxide, titanium oxide, cerium oxide and zirconium oxide particles.

4. The electrophotographic photoreceptor of claim 1, wherein the metal oxide particles have an average particle size of from about 1 to about 250 nanometers.

5. The electrophotographic photoreceptor of claim 1, wherein the metal oxide particles have an average particle size of from about 1 to about 50 nanometers.

6. The electrophotographic photoreceptor of claim 1, wherein the metal oxide particles have a BET of about 1 $m^2/g$ to about 75 $m^2/g$.

7. The electrophotographic photoreceptor of claim 1, wherein the metal oxide particles have a BET of about 20 $m^2/g$ to about 42 $m^2/g$.

8. The electrophotographic photoreceptor of claim 1, wherein the metal oxide particles are aluminum oxide particles.

9. The electrophotographic photoreceptor of claim 1, wherein the metal oxide particles are present in an amount of about 2% to about 20% of a total weight of the overcoat layer.

10. The electrophotographic photoreceptor of claim 1, wherein the metal oxide particles are present in an amount selected from about 2%, about 5%, about 10% and about 20% of a total weight of the overcoat layer.

11. The electrophotographic photoreceptor of claim 1, wherein the at least one siloxane-containing compound contains two or more silicon atoms in its structure.

12. The electrophotographic photoreceptor of claim 1, wherein the overcoat comprises a siloxane-containing hole transport component containing at least one active silicone group, a binder containing at least two silicone functional group, a resin, and metal oxide particles.

13. The electrophotographic photoreceptor of claim 12, wherein the siloxane-containing hole transport component is a triarylamine.

14. The electrophotographic photoreceptor of claim 12, wherein the siloxane-containing hole transport component is member selected from the group consisting of:

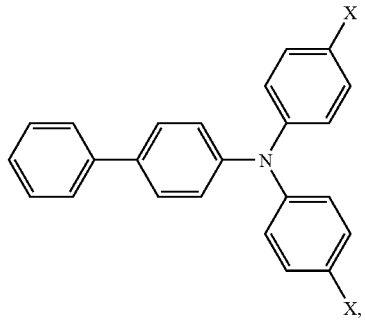

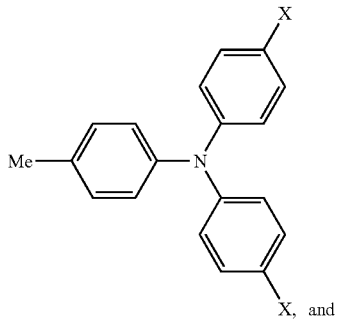

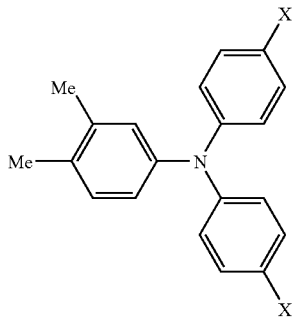

wherein X is at least one member selected from the group consisting of:

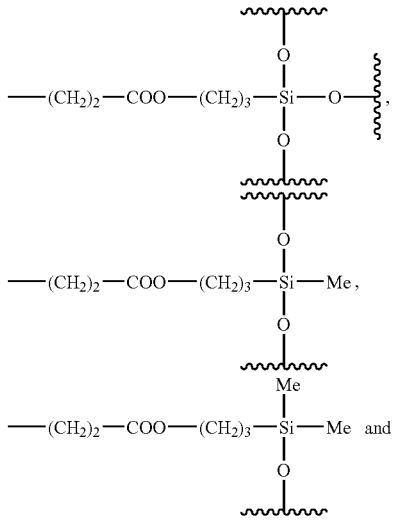

-continued
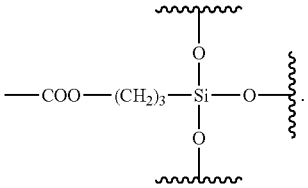
15. An electrophotographic photoreceptor comprising:
a charge generating layer;
a charge transport layer;
an overcoat layer comprising:
a crosslinked siloxane composite composition;
a hole transport component selected from the group consisting of
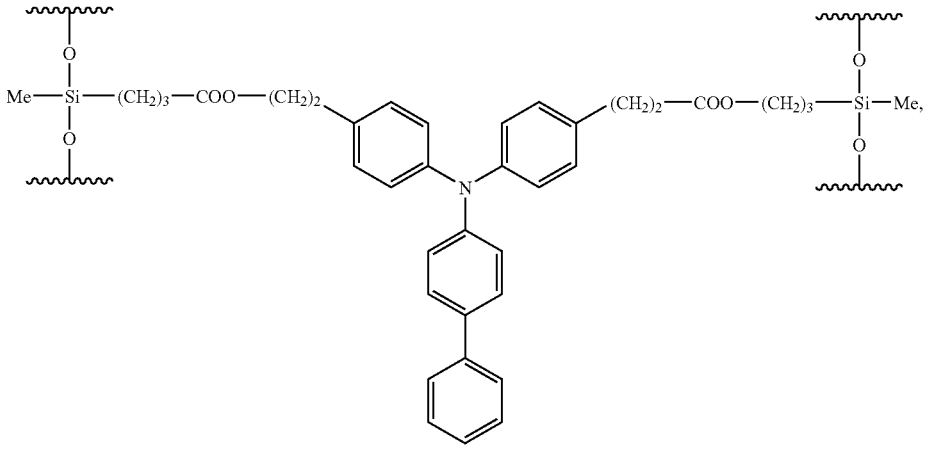
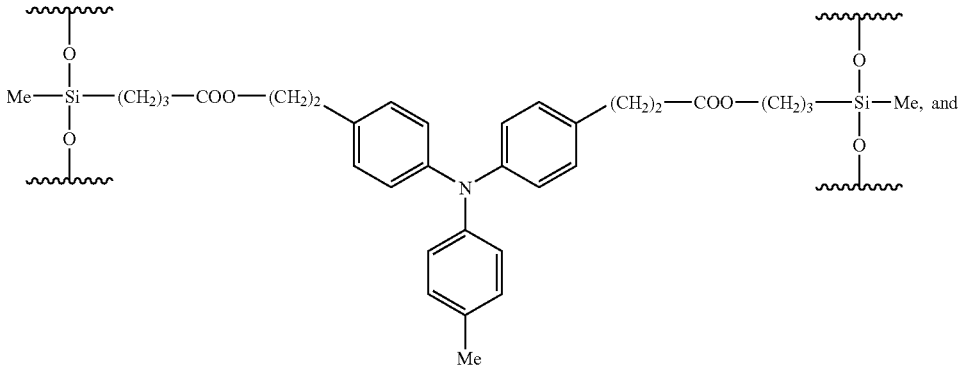
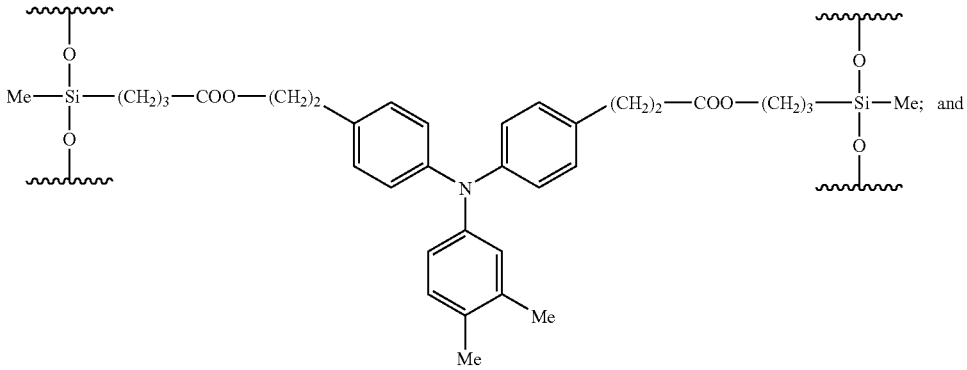

a siloxane containing binder component of

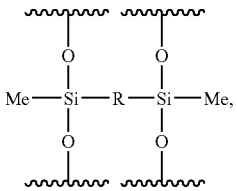

wherein R is a hydrocarbon divalent group having C1 to C30;

a polyvinylbutyral resin; and alumina particles, wherein the alumina particles are non-porous and 50 percent of the alumina oxide particles have a γ-type crystalline structure.

16. An electrophotographic photoreceptor of claim 15, wherein the alumina particles are prepared by plasma synthesis or vapor phase synthesis, have a BET of from about 1 $m^2/g$ to about 75 $m^2/g$, an average particle size of from about 1 to about 250 nanometers.

17. An electrophotographic photoreceptor of claim 15, wherein the R of siloxane-containing binder component is selected from a group consisting of $—(CH_2)_a—$, and $—(CH_2)_b—Ar—(CH_2)_b—$; wherein Ar is an aromatic group, a is an integer of 2 to 6, and b is an integer of 0-5.

18. An electrophotographic photoreceptor of claim 15, wherein the overcoat layer contains from about 20% to about 60% of the hole transport component, from about 20% to about 60% of the siloxane-containing binder component, from about 2% to about 15% of the polyvinylbutyral resin, and from about 2% to about 20% of the alumina particles; wherein a total weight of all components is 100%.

19. A process cartridge comprising at least one of a developing unit and a cleaning unit, and the electrophotographic photoreceptor of claim 1.

20. An image forming apparatus comprising at least one charging unit, at least one exposing unit, at least one developing unit, a transfer unit, a cleaning unit, and the electrophotographic photoreceptor of claim 1.

21. The image forming apparatus of claim 20, wherein the transfer unit is an intermediate transfer body for temporarily transferring the toner image formed on the electrophotographic photoreceptor.

22. The image forming apparatus of claim 21, comprising a plurality of electrophotographic photoreceptors arranged along the intermediate transfer body.

* * * * *